US007223131B2

(12) United States Patent
Moll et al.

(10) Patent No.: US 7,223,131 B2
(45) Date of Patent: May 29, 2007

(54) THREE POSITION ELECTRICAL CONNECTOR ASSEMBLY

(75) Inventors: Hurley Chester Moll, Harrisburg, PA (US); James Michael Raudenbush, Halifax, PA (US); John Wesley Hall, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/219,290

(22) Filed: Sep. 2, 2005

(65) Prior Publication Data

US 2007/0054543 A1 Mar. 8, 2007

(51) Int. Cl.
*H01R 13/514* (2006.01)

(52) U.S. Cl. ..... 439/752; 439/595

(58) Field of Classification Search ..... 439/752, 439/595, 489, 744, 746
See application file for complete search history.

(56) References Cited

U.S. PATENT DOCUMENTS

| | | | | |
|---|---|---|---|---|
| 4,750,893 | A | 6/1988 | Sueyoshi et al. | |
| 5,076,806 | A | 12/1991 | Hotea et al. | |
| 5,098,315 | A * | 3/1992 | Scowen | 439/587 |
| 5,252,096 | A * | 10/1993 | Okada | 439/752 |
| 5,342,223 | A * | 8/1994 | Geib | 439/752 |
| 5,389,014 | A | 2/1995 | Kümpel et al. | |
| 5,643,009 | A | 7/1997 | Dinkel et al. | |
| 5,928,038 | A * | 7/1999 | Berg et al. | 439/752 |
| 6,422,903 | B1 * | 7/2002 | Fekonja et al. | 439/752 |
| 6,676,445 | B2 | 1/2004 | Hall et al. | |
| 6,743,051 | B2 | 6/2004 | Hayashi | |
| 6,780,045 | B2 | 8/2004 | Shuey et al. | |
| 6,824,403 | B2 | 11/2004 | Hall et al. | |
| 6,893,277 | B2 | 5/2005 | Parrish et al. | |
| 6,994,598 | B2 * | 2/2006 | Holmes et al. | 439/752.5 |
| 2004/0038596 | A1 * | 2/2004 | Bartholoma et al. | 439/752 |
| 2005/0106950 | A1 * | 5/2005 | Fink et al. | 439/752 |

OTHER PUBLICATIONS

Tyco Electronics, Drawing No. 14885C2, Plug Kit, Unassembled, 2 pgs. (available at least as early as Sep. 1, 2004).
Tyco Electronics, Drawing No. 14885C9, Jack Kit, Unassembled, 2 pgs. (available at least as early as Sep. 1, 2004).
Amphenol RF engineering Drawing No. FA3-141P-X, "Locking 3 Position", 1 pg., approved Sep. 26, 2003.
Amphenol RF engineering Drawing No. FA3-141J-X, "Locking 3 Position", 1 pg., approved Sep. 26, 2003.

* cited by examiner

*Primary Examiner*—Hien Vu

(57) ABSTRACT

An electrical connector assembly including a housing for receiving a plurality of electrical connectors is disclosed. A connector position assurance device (CPA) is configured to be received within the housing and to restrict axial movement of the electrical connectors. The electrical connectors include shells having shoulders configured to be received within non-cylindrical portions of axial passageways formed within the housing.

24 Claims, 11 Drawing Sheets

THREE POSITION ELECTRICAL CONNECTOR ASSEMBLY

BACKGROUND AND SUMMARY OF THE INVENTION

The present invention relates generally to electrical connectors and, more particularly, to a three position coaxial cable connector assembly.

Radio frequency (RF) coaxial cable connector assemblies have been used for numerous automotive applications, such as global positioning systems (GPS), car radios, mobile phones, air bag systems, and multimedia devices. Coaxial cables typically consist of an outer conductor, an inner conductor, a dielectric, and a jacket. The outer conductor and the inner conductor of the cable often electrically interface with a mating coaxial cable through jack and plug connectors. Such conventional coaxial cable connectors are known in the art, for example, in U.S. Pat. Nos. 6,676,445 and 6,824,403, which are assigned to the assignee of the present invention and are expressly incorporated by reference herein.

Certain automotive applications may require that multiple coaxial cables be coupled through a single connector assembly. For example, three position connector assemblies are often used to electrically couple three coaxial jack connectors with three coaxial plug connectors.

Typically, electrical connector assemblies have retention means in a housing in order to secure the electrical connectors therein. One such retainer is a plastic movable member which is configured to move in place over the connector to lock the connector in place. Some of such movable members are moved transversely to the axial direction, while others are designed as hinged flaps which are rotated into place.

In order to standardize various types of connectors and thereby avoid confusion, certain industry standards have been established. One of these standards is referred to as FAKRA. FAKRA is the Automotive Standards Committee in the German Institute for Standardisation, representing international standardization interests in the automotive field. The FAKRA standard provides a system, based on keying and color coding, for proper connector attachment. Like jack keys can only be connected to like plug keyways in FAKRA connectors. Secure positioning and locking of connector housings is facilitated by way of a FAKRA defined catch on the jack housing and a cooperating latch on the plug housing.

According to an illustrative embodiment of the current disclosure, a connector position assurance device for use in an electrical connector assembly is provided. The connector position assurance device includes a first leg, a second leg, and a bridge member connecting the first leg and the second leg. A first engagement surface is supported by the first leg and is configured to engage a shoulder of a first electrical connector to restrict axial movement thereof. A second engagement surface is supported by the second leg and is configured to engage a shoulder of a second electrical connector to restrict axial movement thereof. A third engagement surface is supported by the bridge member and is configured to engage a shoulder of a third electrical connector to restrict axial movement thereof.

According to a further illustrative embodiment of the disclosure, an electrical connector assembly includes a housing having a plurality of axial passageways, each of the axial passageways defining a longitudinal axis and including a non-cylindrical portion having at least one flat. A plurality of electrical connectors are configured to be received within the plurality of axial passageways. Each of the electrical connectors includes a shell having a shoulder configured to be received within the non-cylindrical portion of one of the axial passageways. The at least one flat of each non-cylindrical portion extends parallel to and in close proximity to one of the flats of an adjacent non-cylindrical portion, thereby facilitating close spacing of the longitudinal axes of the plurality of axial passageways.

According to yet another illustrative embodiment of the disclosure, an electrical connector assembly includes a housing having a plurality of axial passageways and a transverse slot. A plurality of electrical connectors are configured to be received within the plurality of axial passageways, each of the electrical connectors including a shell having an annular groove. A connector position assurance device is configured to be received within the transverse slot and includes a plurality of arcuate engagement surfaces. Each of the engagement surfaces is configured to be received within one of the annular grooves of the shells.

DESCRIPTION OF INVENTION

Figure 1:
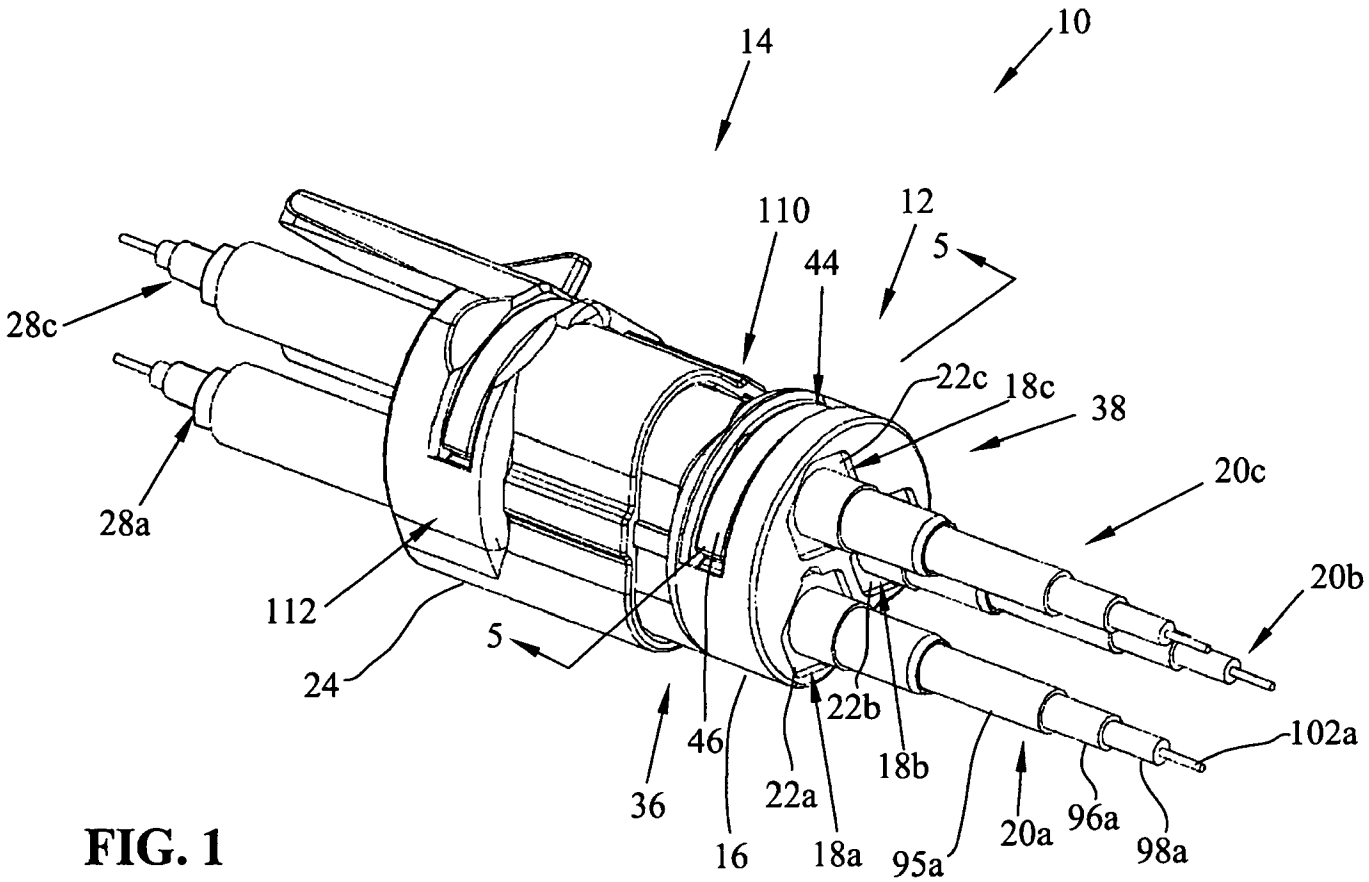
FIG. 1 is a top perspective view of an illustrative embodiment electrical connector assembly of the present disclosure.
Figure 2:
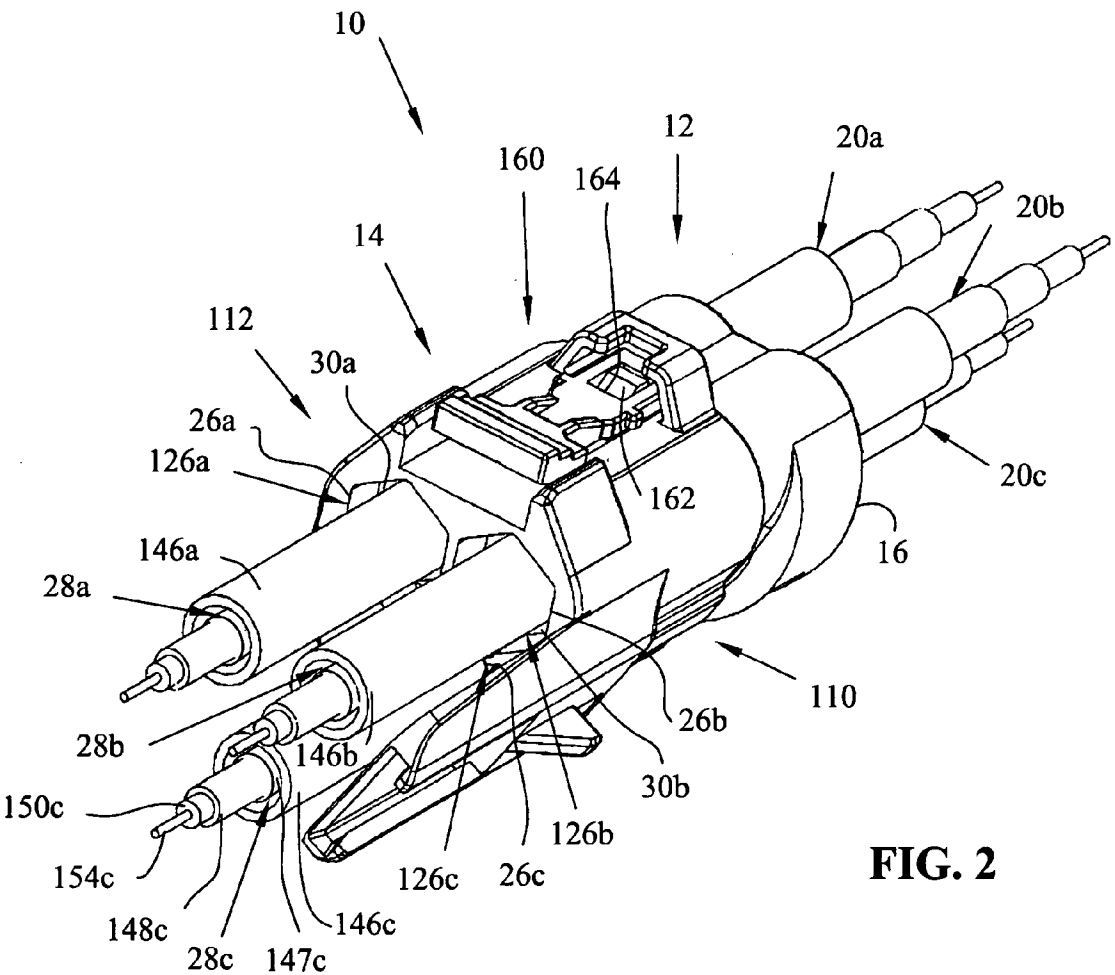
FIG. 2 is a bottom perspective view of the electrical connector assembly of FIG. 1.
Figure 3:
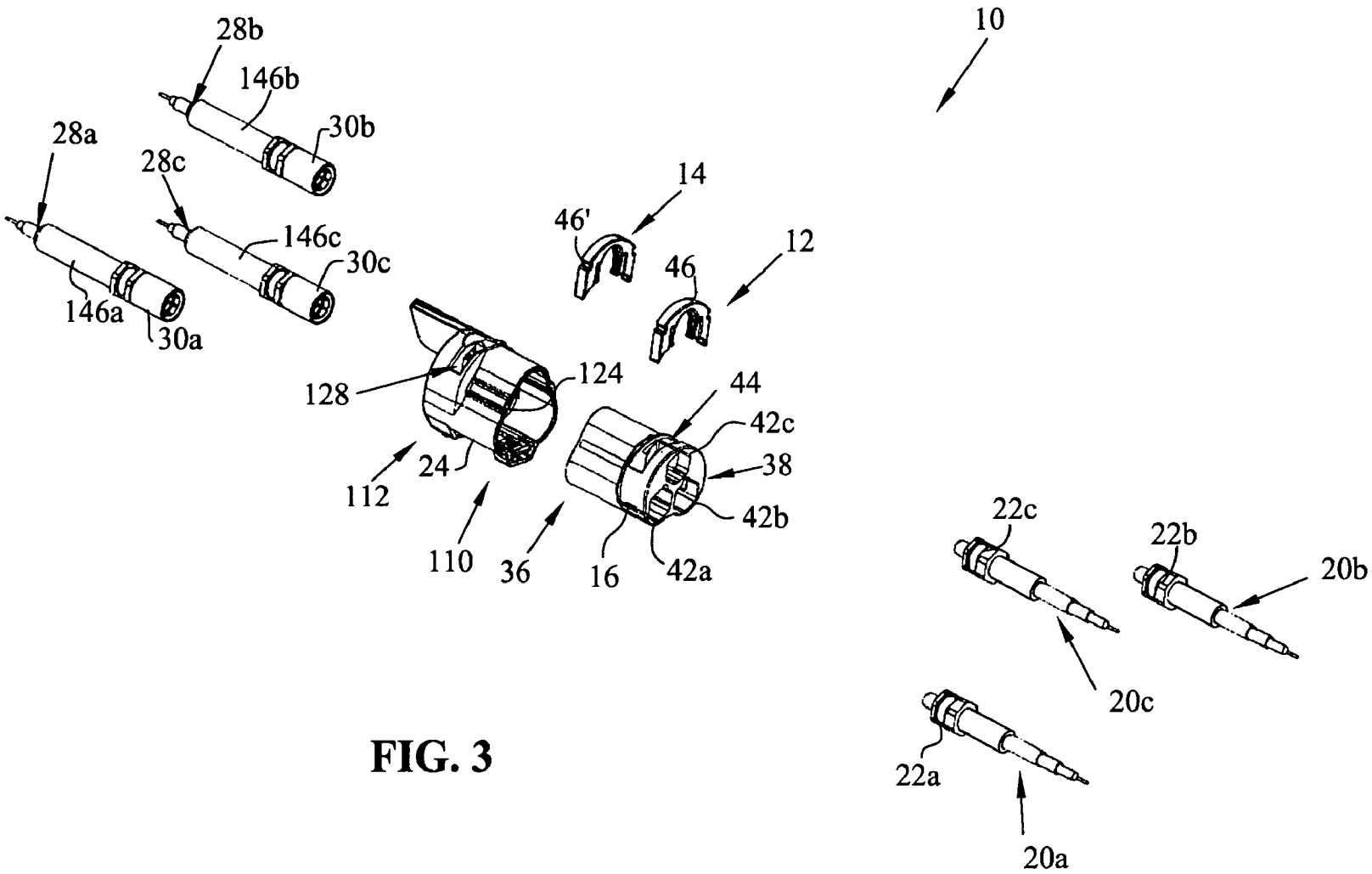
FIG. 3 is a partially exploded perspective view of the electrical connector assembly of FIG. 1.

Referring initially to FIGS. 1–3, an electrical connector assembly 10 according to the present disclosure includes a jack assembly 12 which is configured to couple to a plug assembly 14. The jack assembly 12 includes a jack housing 16 having a plurality of axial passageways 18*a*, 18*b*, 18*c* which define longitudinal axes 19*a*, 19*b*, 19*c* and are configured to receive corresponding coaxial cables 20*a*, 20*b*, 20*c*. The coaxial cables 20*a*, 20*b*, 20*c* each include a conventional jack connector 22 (FIG. 8), referred to in FIGS. 1–3 as 22*a*, 22*b*, 22*c*.

The plug assembly 14 similarly includes a plug housing 24 having a plurality of axial passageways 26*a*, 26*b*, 26*c* which define longitudinal axes 27*a*, 27*b*, 27*c* and are configured to receive coaxial cables 28*a*, 28*b*, 28*c*. Each of the coaxial cables 28*a*, 28*b*, 28*c* includes a conventional plug connector 30 (FIG. 10), referred to in FIGS. 1–3 as 30*a*, 30*b*, 30*c*. Each plug connector 30 is configured to receive a corresponding jack connector 22 and provide electrical communication between respective cables 20*a*, 20*b*, 20*c* and 28*a*, 28*b*, 28*c*.

Figure 4:
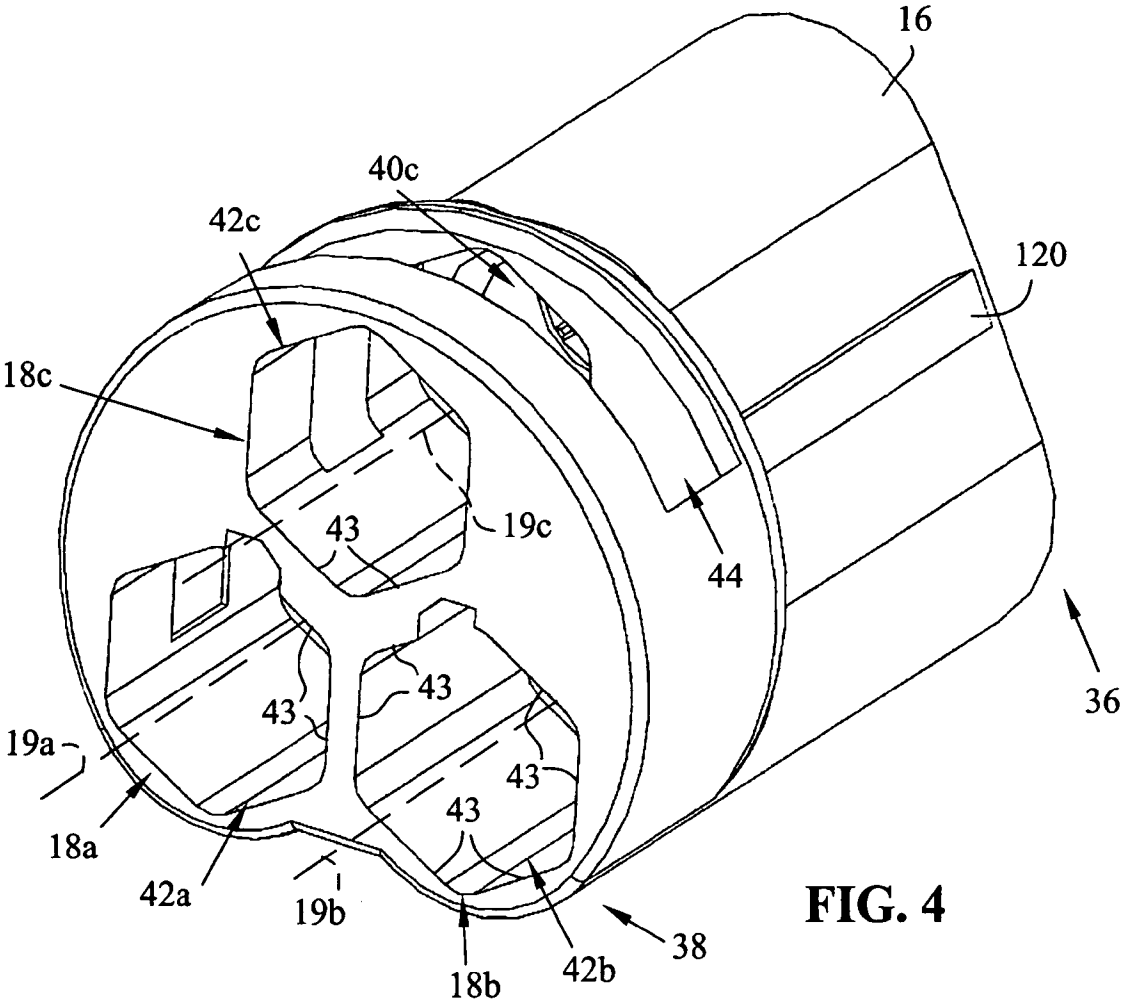
FIG. 4 is a perspective view of the jack housing of the present disclosure.

With reference to FIGS. 1, 3, and 4, the jack housing 16 includes a front mating end 36 and a rear connector receiving end 38. As best shown in FIG. 4, the passageways 18*a*, 18*b*, 18*c* each include a cylindrical portion 40 adjacent the mating end 36 and a non-cylindrical, illustratively hexagonal, portion 42 adjacent the connector receiving end 38 (FIG. 4). Passageway 18*c* is positioned vertically above passageways 18*a* and 18*b* and is laterally offset therefrom. In such an arrangement, the hexagonal portions 42 facilitate efficient space utilization by placing the passageways 18*a*, 18*b*, 18*c* in close proximity to each another. More particularly, each hexagonal portion 42 includes six planar walls or flats 43, wherein at least one of the flats 43 of each hexagonal portion 42 extends parallel to and in close proximity to one of the flats 43 of an adjacent hexagonal portion 42. The proximity of parallel flats 43 conserves space by closely positioning the longitudinal axes 19 of the axial passageways 18. In the illustrative embodiment, each hexagonal portion 42 shares a pair of flats 43 with the two adjacent hexagonal portions 42.

Figure 5:
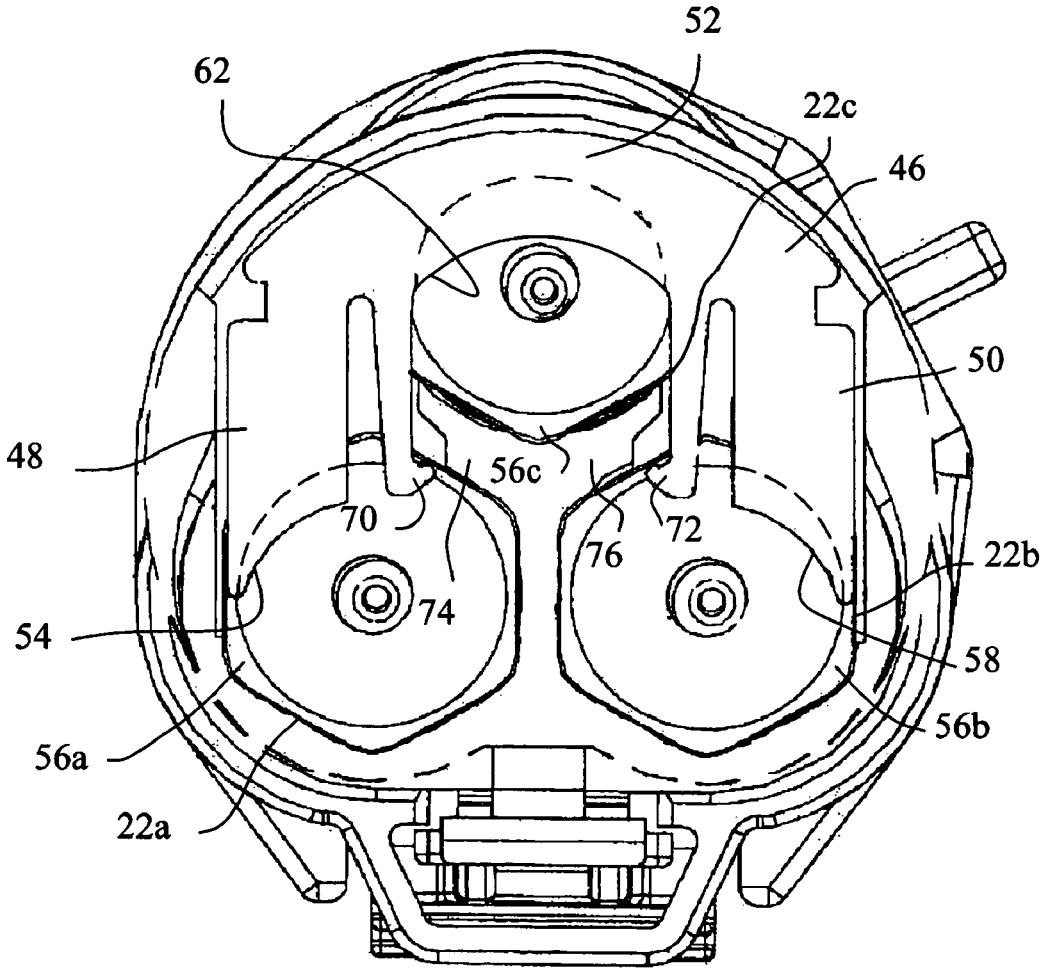
FIG. 5 is a cross-sectional view of the jack assembly taken along line 5—5 of FIG. 1.
Figure 6:
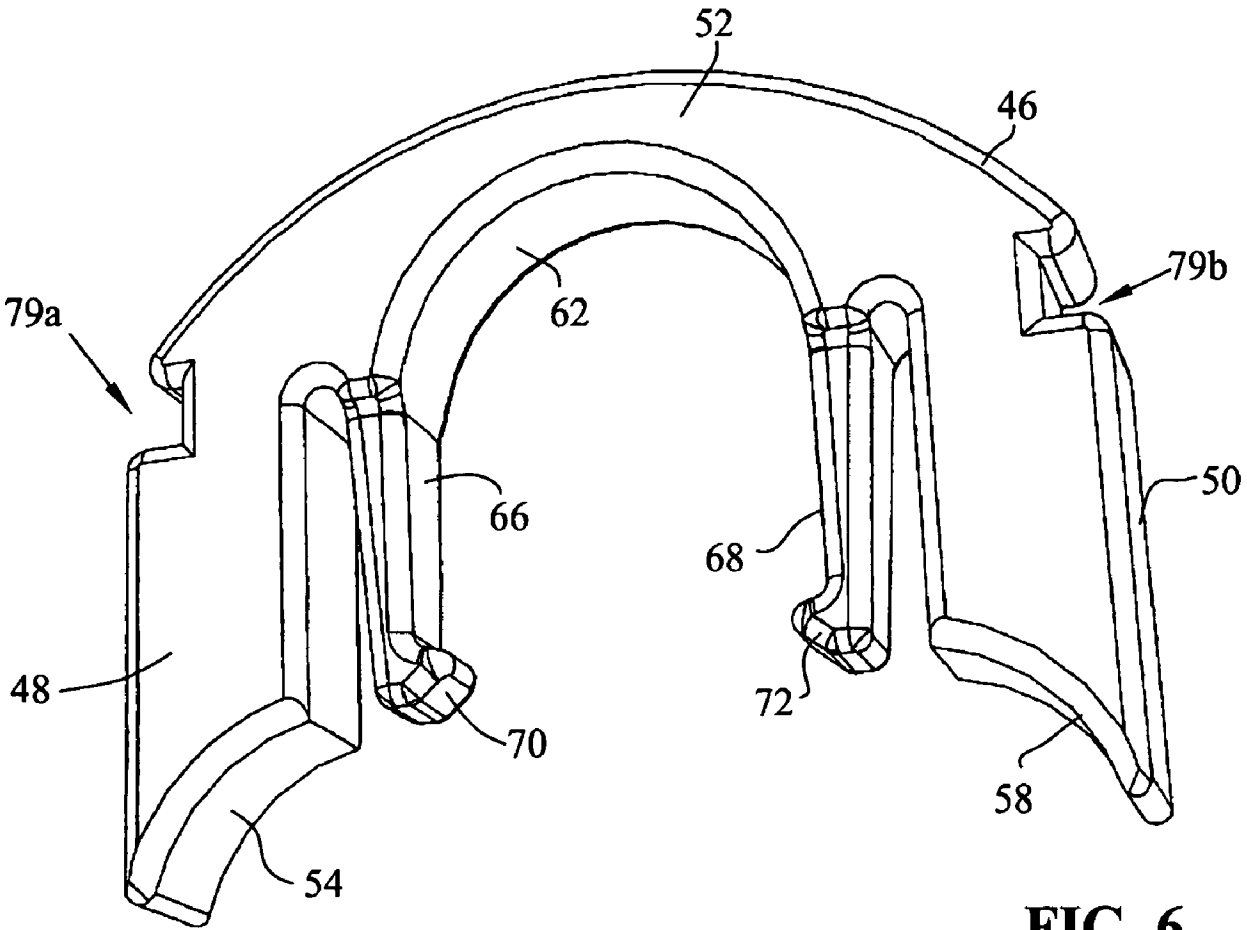
FIG. 6 is a perspective view of a connector position assurance device of the present disclosure.
Figure 7:
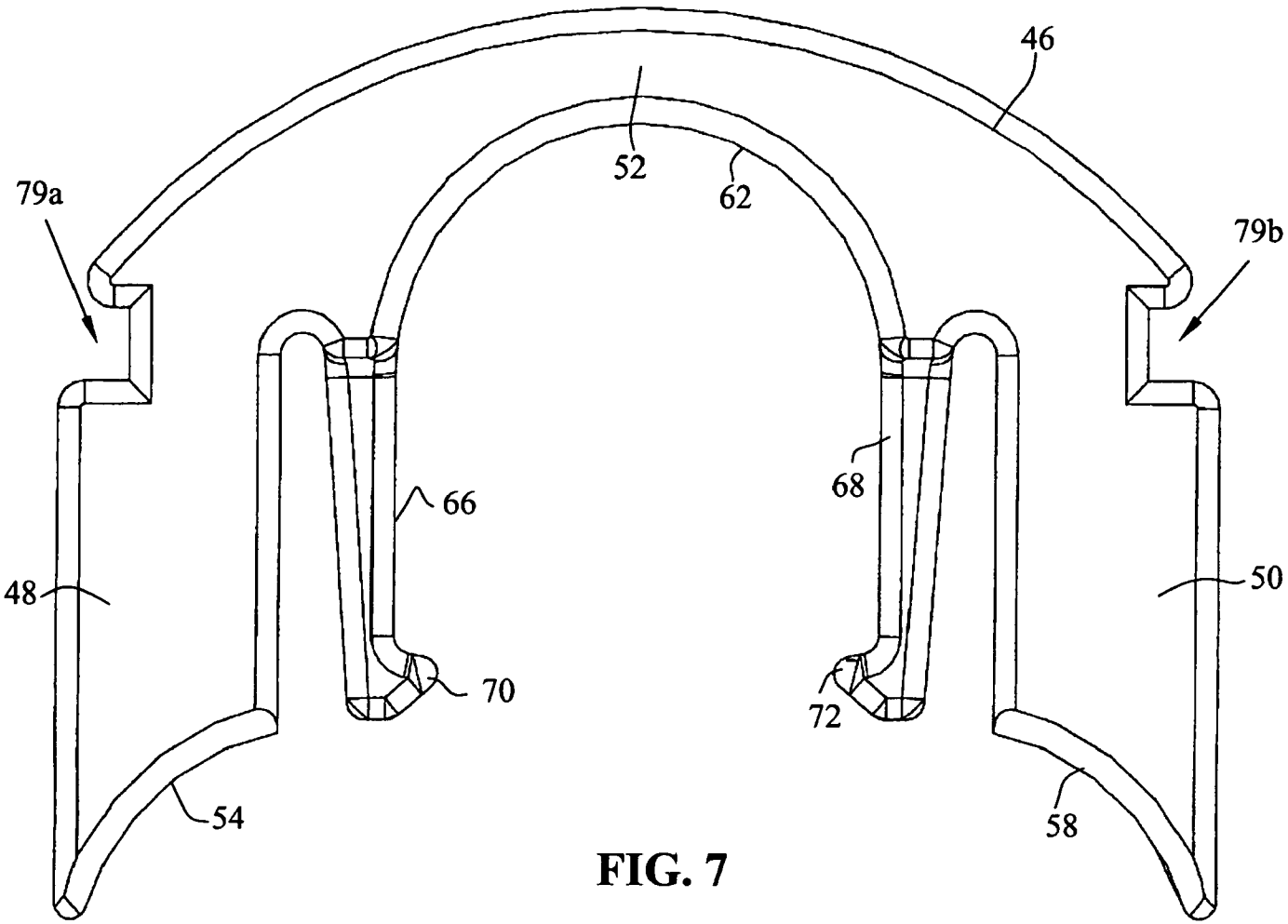
FIG. 7 is a front elevation view of the connector position assurance device of FIG. 6.

In addition to axial passageways 18*a*, 18*b*, 18*c*, the jack housing 16 includes a transverse slot 44 configured to slidably receive a lock or connector position assurance device (CPA) 46. With reference to FIGS. 5–7, the CPA 46 includes a first leg 48, a second leg 50, and an arcuate bridge member 52 connecting the first leg 48 and the second leg 50. A first arcuate engagement surface 54 is supported by the first leg 48 and is configured to engage a shoulder 56*a* (FIG. 5) of the first jack connector 22*a* to restrict axial movement thereof. Similarly, a second arcuate engagement surface 58 is supported by the second leg 50 and is configured to engage a shoulder 56*b* of the second jack connector 22*b* to restrict axial movement thereof. A third arcuate engagement surface 62 is supported by the bridge member 52 and is configured to engage shoulder 56*c* of the third electrical connector 22*c* to restrict axial movement thereof.

The first engagement surface 54 has a first radius of curvature, the second engagement 58 has a second radius of curvature and the third engagement surface 62 has a third radius of curvature. In one illustrative embodiment, the third radius of curvature is greater than both the first radius of curvature and the second radius of curvature to facilitate positioning of a larger jack connector 22*c* within the axial passageway 18*c*.

First and second latches or latch arms 66 and 68 extend downwardly from the bridge member 52 intermediate the first and second legs 48 and 50. The latches 66 and 68 each include a latch lug 70 and 72 which is configured to couple the bridge member 52 to the jack housing 16. The first and second latch arms 66 and 68 are illustratively formed as an integral part of the CPA 46 and are resiliently biased in a direction toward each other. More particularly, the latch lugs 70 and 72 are biased inwardly to couple the CPA 46 to retaining ledges 74 and 76 defined by an internal wall 78 of the jack housing 16 (FIG. 5). A pair of slots 79*a* and 79*b* are illustratively positioned at opposing ends of the bridge member 52 and are configured to receive a tool (not shown) for facilitating removal of the CPA 46 from the housing 16.

Figure 8:
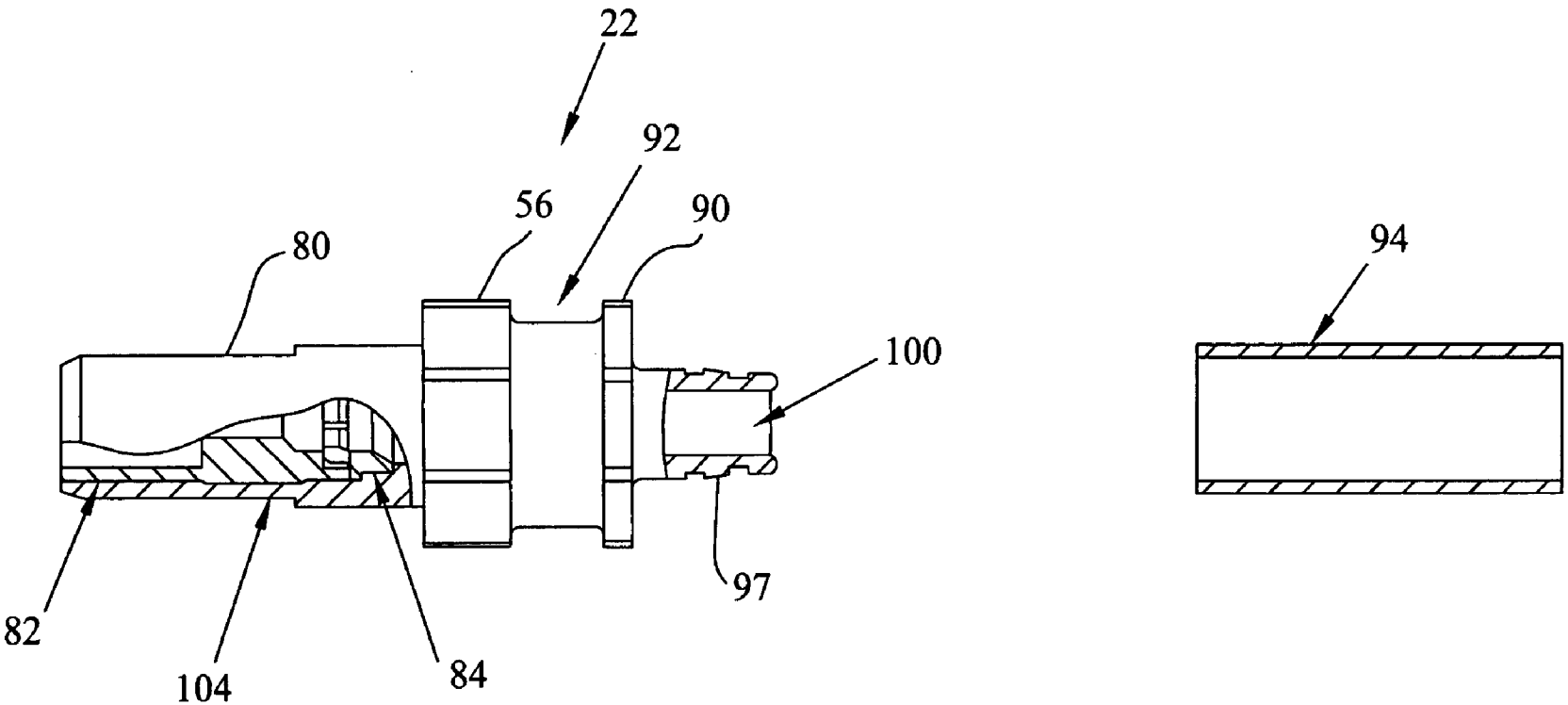
FIG. 8 is a side elevation view, in partial cross-section, of a jack connector and ferrule.

Referring now to FIGS. 1 and 8, the jack connector 22 illustratively includes an outer shell 80 which receives traditional coaxial components including a front dielectric 82 and a rear dielectric 84. As known, the front dielectric 82 and the rear dielectric 84 may be replaced with a single dielectric. The shell 80 includes radially outwardly extending flanges or shoulders 56 and 90 which define an annular groove 92 therebetween. A cylindrical ferrule 94 extends outwardly from the shell 80 and is configured to retain the outer conductor 96 and the jacket 95 of the coaxial cable 20. More particularly, the outer conductor 96 of the coaxial cable 20 is received within the jacket 95 and is coupled between a cylindrical mount 97 of the shell 80 and the mating ferrule 94. Cable dielectric 98 passes into an interior bore 100. Inner conductor 102 of cable 20 passes through the interior bore 100 where it is crimped and/or soldered to a pin contact (not shown) of the jack connector 22 in a conventional manner.

The shell 80 has a cylindrical body 104 such that the groove 92 includes a cylindrical cross-section. The shoulders 56 and 90 illustratively have a hexagonal cross-section and are configured to cooperate with the hexagonal portion 42 of the axial passageways 18*a*, 18*b*, 18*c*. The engagement surfaces 54, 58, 62 of the CPA 46 are configured to be received within the grooves 92 such that engagement with the shoulders 56 and 90 restricts axial movement of the shells 80.

Figure 9:
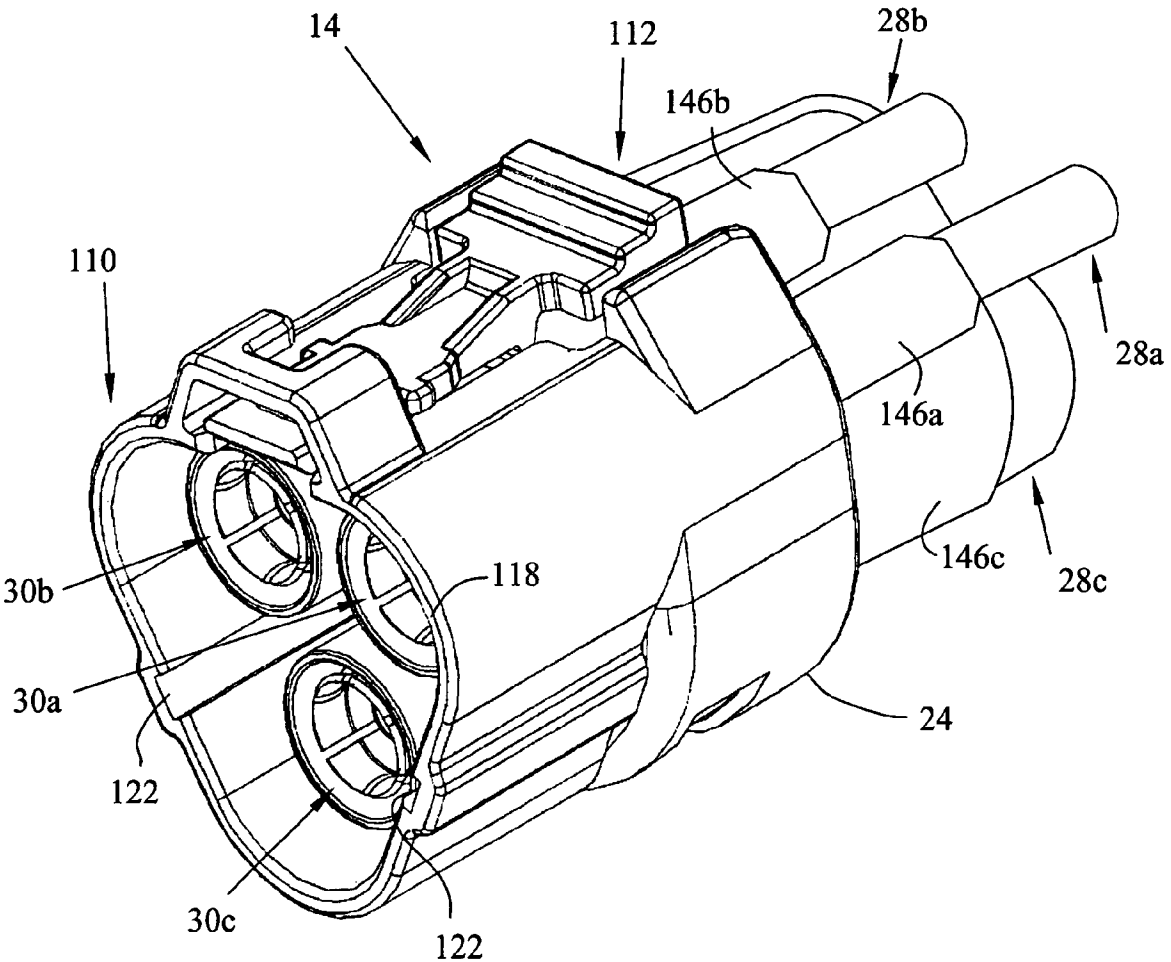
FIG. 9 is a first end perspective view of a plug housing and plug connectors of the present disclosure.

With reference to FIGS. 2, 3, 9, and 10, the plug housing 24 includes a front mating end 110 and a rear connector receiving end 112. The mating end 110 includes a receiving flange 118 configured to slidably receive the mating end 36 of the jack housing 16. The jack housing 16 includes a plurality of alignment ribs 120 (FIG. 4) which are configured to be received within alignment grooves 122 formed within the plug housing 24 (FIG. 9). By ensuring such positioning, the passageways 18 of the jack housing 16 are coaxially aligned with the passageways 26 of the plug housing 24.

Figure 10:
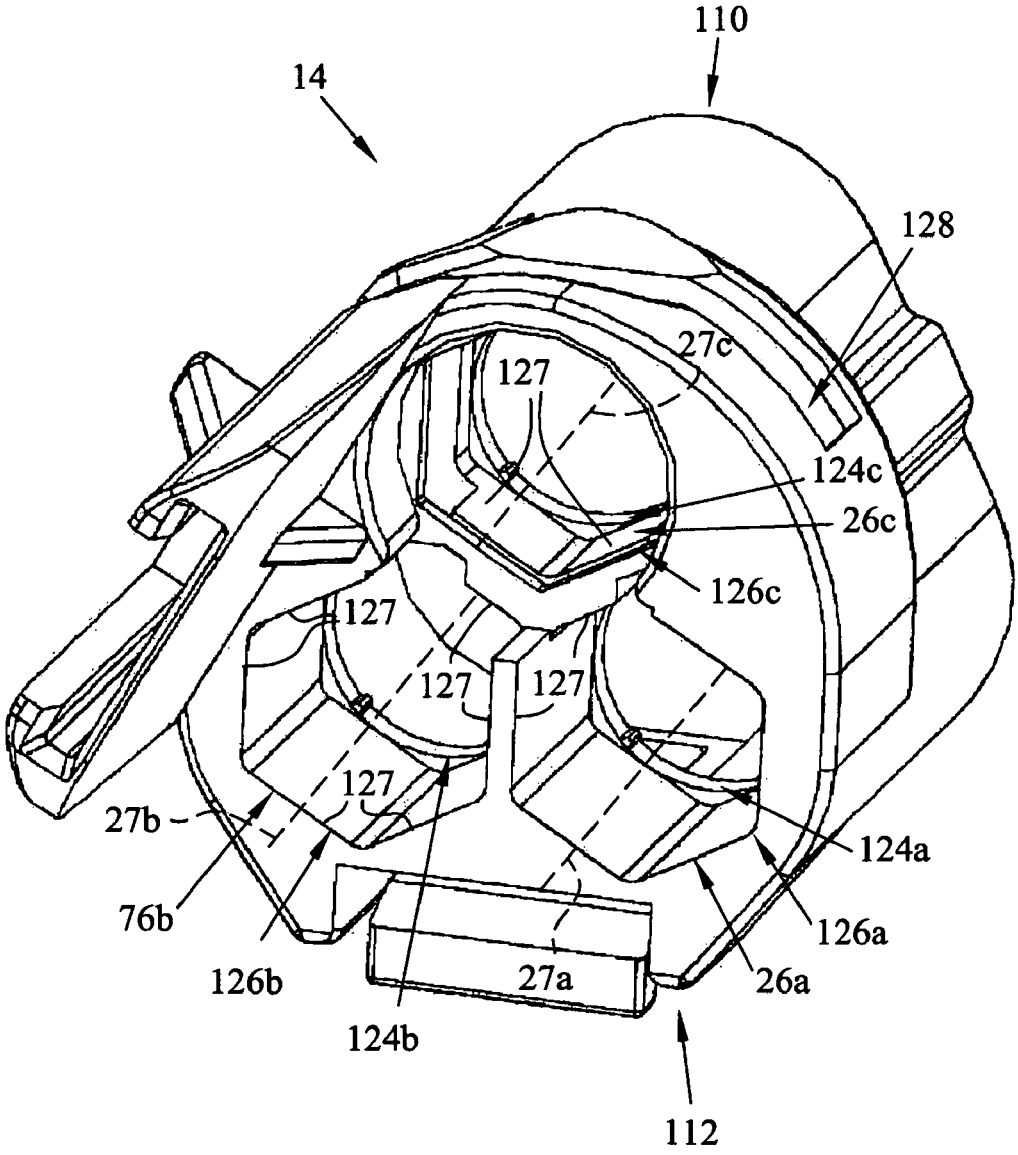
FIG. 10 is a second end perspective view of a plug housing of the present disclosure.

With reference to FIG. 10, the passageways 26*a*, 26*b*, 26*c* each include a cylindrical portion 124 adjacent the mating end 110 and a non-cylindrical, illustratively hexagonal, portion 126 adjacent the connector receiving end 112 (FIG. 10). Passageway 26*c* is positioned vertically above passageways 26*a* and 26*b* and is laterally offset therefrom. In such an arrangement, the hexagonal portions 126 facilitate efficient space utilization by placing the passageways 26*a*, 26*b*, 26*c* in close proximity to each other. More particularly, each hexagonal portion 126 includes six flats 127, wherein at least one of the flats 127 of each hexagonal portion 126 extends parallel to and in close proximity to one of the flats 127 of an adjacent hexagonal portion 126. The proximity of parallel flats 127 conserves space by closely positioning the longitudinal axes 27 of the axial passageways 26. In the illustrative embodiment, each hexagonal portion 126 shares flats 127 with the two adjacent hexagonal portions 126. In addition to the axial passageways 26, the plug housing 24 includes a transverse slot 128 configured to slidably receive a connector position assurance device (CPA) 46'. The CPA 46' is illustratively identical to the CPA 46 described in detail above.

Figure 11:
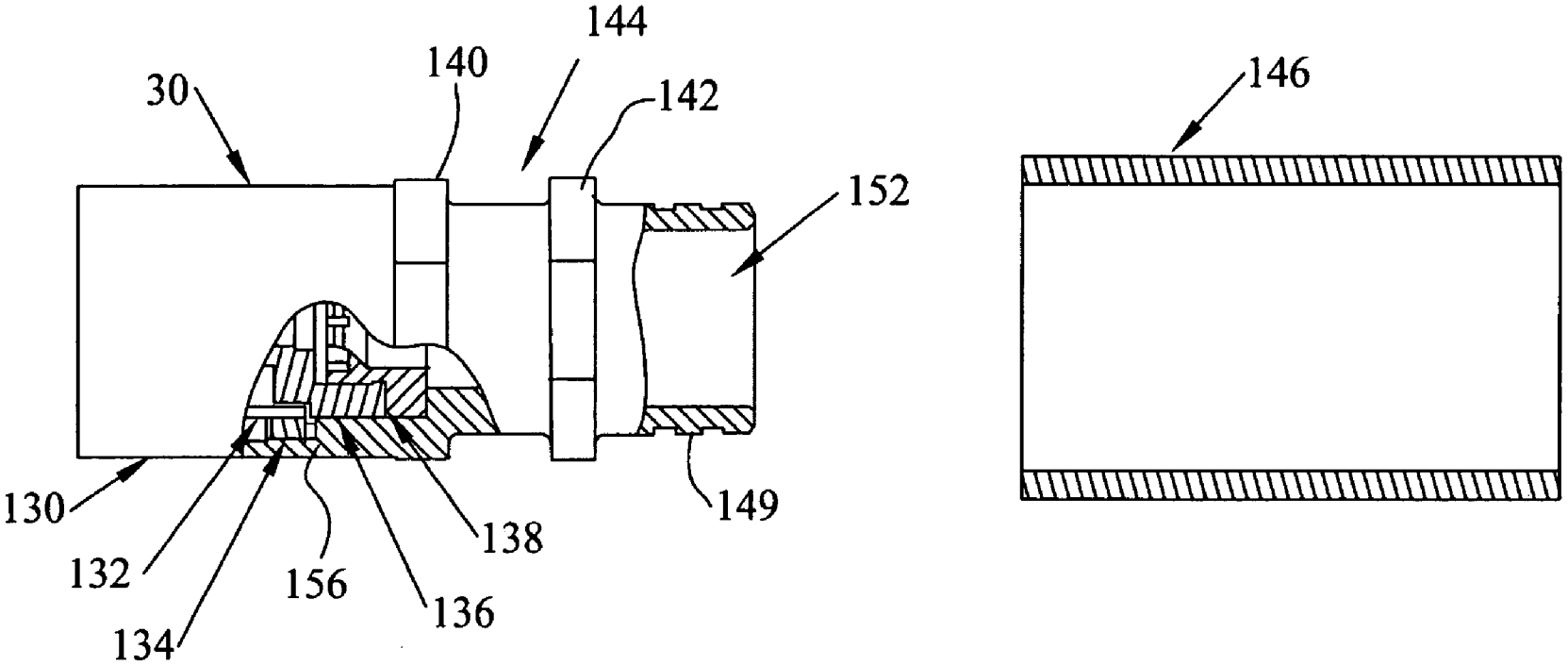
FIG. 11 is a side elevational view, in partial cross-section, of a plug connector and ferrule.

Referring now to FIGS. 2 and 11, the plug connector 30 includes an outer shell 130 which receives traditional coaxial components including an outer contact 132, a retaining ring 134, a front dielectric 136, and a rear dielectric 138. As known, the front dielectric 136 and the rear dielectric 138 could be replaced with a single dielectric. The shell 130 includes radially outwardly extending flanges or shoulders 140 and 142 which define an annular groove 144 therebetween. A cylindrical ferrule 146 extends outwardly from the shell 130 and is configured to retain the coaxial cable 28. More particularly, the outer conductor 148 of the coaxial cable 28 is received within a jacket 147 and is mounted between a cylindrical mount 149 of the shell 130 and the mating ferrule 146. Cable dielectric 150 passes into an interior bore 152. Inner conductor 154 of cable 28 passes through the interior bore 152 where it is crimped and/or soldered to a socket contact (not shown) of the plug connector 30 in a conventional manner.

The shell 130 has a cylindrical body 156 such that the groove 144 includes a cylindrical cross-section. The shoulders 140 and 142 illustratively have a hexagonal cross-section and are configured to cooperate with the hexagonal portion 126 of the axial passageways 26. The engagement surfaces 54, 58, 62 of the CPA 46' are configured to be received within the groove 144 such that engagement with the shoulders 140 and 142 restricts axial movement of the shells 130.

As shown in FIG. 2, a conventional latch 160 may be configured to releasably couple the jack housing 16 with the plug housing 24. More particularly, a catch 162 supported by the jack housing 16 may be positioned within an opening 164 supported by the plug housing 14 to secure together the jack assembly 12 and plug assembly 14.

The invention claimed is:

1. A connector position assurance device for use in an electrical connector assembly, the connector position assurance device comprising:

a first leg;

a second leg;

a bridge member connecting the first leg and the second leg;

a first engagement surface supported by the first leg and configured to engage a shoulder of a first electrical connector to restrict axial movement thereof;

a second engagement surface supported by the second leg and configured to engage a shoulder of a second electrical connector to restrict axial movement thereof;

a third engagement surface supported by the bridge member and configured to engage a shoulder of a third electrical connector to restrict axial movement thereof; and a latch assembly defined for latching engagement with a housing of the electrical connector assembly when moved in the direction along a plane of the first and second engagement surface; wherein the latch assembly comprises: a first latch extending from the bridge member intermediate the first leg and the second leg; and a second latch extending from the bridge member intermediate the first leg and the second leg, and positioned in spaced relation to the first latch.

2. The connector position assurance device of claim 1, wherein the bridge member extends arcuately from the first leg to the second leg.

3. The connector position assurance device of claim 1, wherein the engagement surfaces are arcuate.

4. The connector position assurance device of claim 3, wherein the first engagement surface has a first radius of curvature, the second engagement surface has a second radius of curvature, and the third engagement surface has a third radius of curvature, the third radius of curvature being greater than the first radius of curvature and the second radius of curvature.

5. The connector position assurance device of claim 1, wherein:

the first leg, the second leg, and the bridge member are configured to be received within a slot formed within a housing;

the first engagement surface is configured to be received within a groove formed within the first electrical connector;

the second engagement surface is configured to be received within a groove formed within the second electrical connector; and the third engagement surface is configured to be received within a groove formed within the third electrical connector.

6. The connector position assurance device of claim 1, wherein the first latch and the second latch each include a latch lug configured to couple the bridge member to a housing.

7. The connector position assurance device of claim 6, wherein the first latch and the second latch are resiliently biased in a direction toward each other.

8. An electrical connector assembly comprising:

a housing including a plurality of axial passageways, each of the axial passageways defining a longitudinal axis and including a non-cylindrical portion having at least one flat;

a plurality of electrical connectors configured to be received within the plurality of axial passageways, each of the electrical connectors including a cylindrical shell having a non-cylindrical shoulder configured to be received within the non-cylindrical portion of one of the axial passageways; and wherein the at least one flat of each non-cylindrical portion extends parallel to and in close proximity to one of the flats of an adjacent non-cylindrical portion, thereby facilitating close spacing of the longitudinal axes of the plurality of axial passageways; wherein the connector assembly further comprises a connector position assurance device configured to be slidably received within the housing and secure the axial position of the plurality of electrical connectors by engaging the shoulders;

wherein the connector position assurance device includes a first leg, a second leg, a bridge member connecting the first leg and the second leg, a first latch extending from the bridge member, and a second latch extending form the bridge member in spaced relation to the first latch.

9. The electrical connector assembly of claim 8, wherein:

the non-cylindrical portions of the plurality of axial passageways are hexagonal shaped; and the shoulders of the plurality of electrical connectors are hexagonal shaped and configured to be slidably received within the non-cylindrical portions of the plurality of axial passageways.

10. The electrical connector assembly of claim 8, wherein the plurality of axial passageways includes a first axial passageway, a second axial passageway laterally spaced from the first axial passageway, and a third axial passageway positioned above and laterally intermediate the first axial passageway and the second axial passageway.

11. The electrical connector assembly of claim 8, wherein the plurality of electrical connectors includes a first electrical connector, a second electrical connector, and a third electrical connector, the shell of the third electrical connector having a greater cross-sectional area than the shell of the first electrical connector and the shell of the second electrical connector.

12. The electrical connector assembly of claim 8, wherein the connector position assurance device includes a plurality of arcuate engagement surfaces configured to engage the shoulders.

13. The electrical connector assembly of claim 8, wherein each of the shells include a groove configured to receive the connector position assurance device.

14. An electrical connector assembly comprising:

a housing including a plurality of axial passageways, where some of said passageways are laterally spaced from each other and some of said passageways are vertically spaced from each other; and a transverse slot intersecting the passageways;

a plurality of electrical connectors configured to be received within the plurality of axial passageways, each of the electrical connectors including a shell having an annular groove; and a connector position assurance device configured to be received within the transverse slot, the connector position assurance device including a plurality of arcuate engagement surfaces, each of the engagement surfaces configured to be received within one of the annular grooves of the shells; wherein the connector position assurance device includes a first leg, a second leg, a bridge member connecting the first leg and the second leg, a first one of the engagement surfaces support by the first leg, a second one of the engagement surfaces supported by the second leg and a third one of the engagement surfaces support by the bridge member.

15. The electrical connector assembly of claim 14, wherein the connector position assurance device further includes:

a first latch extending from the bridge member intermediate the first leg and the second leg; and a second latch extending from the bridge member intermediate the first leg and the second leg, and positioned in spaced relation to the first latch.

16. The electrical connector assembly of claim 15, wherein the first latch and the second latch each include a latch lug configured to couple the bridge member to a housing.

17. The electrical connector assembly of claim 14, wherein each of the axial passageways includes a hexagonal shaped portion, and each of the shells include a hexagonal shaped shoulder configured to be received within the hexagonal shaped portion of one of the axial passageways.

18. The electrical connector assembly of claim 16, wherein the plurality of axial passageways includes a first axial passageway, a second axial passageway laterally spaced from the first axial passageway, and a third axial passageway positioned above and laterally intermediate the first axial passageway and the second axial passageway.

19. A connector position assurance device for use in an electrical connector assembly, the connector position assurance device comprising:

a first leg;

a second leg;

a bridge member connecting the first leg and the second leg;

a first engagement surface supported by the first leg and configured to engage a shoulder of a first electrical connector to restrict axial movement thereof;

a second engagement surface supported by the second leg and configured to engage a shoulder of a second electrical connector to restrict axial movement thereof;

a third engagement surface supported by the bridge member and configured to engage a shoulder of a third electrical connector to restrict axial movement thereof;

a first latch extending from the bridge member intermediate the first leg and the second leg;

a second latch extending from the bridge member intermediate the first leg and the second leg, and positioned in spaced relation to the first latch; and wherein the first latch and the second latch each include a latch lug configured to couple the bridge member to a housing.

20. The connector position assurance device of claim 19, wherein the bridge member extends arcuately from the first leg to the second leg.

21. The connector position assurance device of claim 19, wherein the engagement surfaces are arcuate.

22. The connector position assurance device of claim 21, wherein the first engagement surface has a first radius of curvature, the second engagement surface has a second radius of curvature, and the third engagement surface has a third radius of curvature, the third radius of curvature being greater than the first radius of curvature and the second radius of curvature.

23. The connector position assurance device of claim 19, wherein:

the first leg, the second leg, and the bridge member are configured to be received within a slot formed within a housing;

the first engagement surface is configured to be received within a groove formed within the first electrical connector;

the second engagement surface is configured to be received within a groove formed within the second electrical connector; and the third engagement surface is configured to be received within a groove formed within the third electrical connector.

24. The connector position assurance device of claim 23, wherein the first latch and the second latch are resiliently biased in a direction toward each other.

* * * * *